US008998366B2

(12) United States Patent
Uchida

(10) Patent No.: US 8,998,366 B2
(45) Date of Patent: Apr. 7, 2015

(54) PRINTING APPARATUS AND PRINTING METHOD

(71) Applicant: Canon Kabushiki Kaisha, Tokyo (JP)

(72) Inventor: Naoki Uchida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/023,679

(22) Filed: Sep. 11, 2013

(65) Prior Publication Data

US 2014/0078202 A1 Mar. 20, 2014

(30) Foreign Application Priority Data

Sep. 19, 2012 (JP) ..... 2012-206312

(51) Int. Cl.
*B41J 2/07* (2006.01)
*B41J 19/20* (2006.01)

(52) U.S. Cl.
CPC . *B41J 2/07* (2013.01); *B41J 19/202* (2013.01)

(58) Field of Classification Search
CPC .... B41J 29/393; B41J 2/04573; B41J 2/2135; B41J 2/04586
USPC ..... 347/8–12, 14, 16, 19, 20, 37, 40
See application file for complete search history.

(56) References Cited

U.S. PATENT DOCUMENTS 6,402,294 B2 * 6/2002 Minowa ..... 347/37
2009/0189937 A1 * 7/2009 Naruse et al. ..... 347/13

FOREIGN PATENT DOCUMENTS

JP 2004-9489 A 1/2004

* cited by examiner

*Primary Examiner* — Thinh Nguyen
(74) *Attorney, Agent, or Firm* — Fitzpatrick, Cella, Harper & Scinto

(57) ABSTRACT

A serial type inkjet printing apparatus performs the following processing. A slant is set between the nozzle arrayed direction and the carriage moving direction for each printing column in the carriage moving direction. The carriage position is detected. Image data stored in a print buffer in association with each printing column is divided based on the detected carriage position and the slant in the printing column corresponding to the set position of the carriage. The image data is read by separating it into respective data used for first-and-second-scan printings by the printhead in an identical region, based on the detected carriage position, and the slant in the printing column corresponding to the set position of the carriage. Printing is performed by first-and-second-scanning the printhead on the identical region, using the read image data.

11 Claims, 14 Drawing Sheets

FIG. 3A

| | a | b | c | d | e | f | g | h | i | j |
|---|---|---|---|---|---|---|---|---|---|---|
| 1 | a1 | b1 | c1 | d1 | e1 | f1 | g1 | h1 | i1 | j1 |
| 2 | a2 | b2 | c2 | d2 | e2 | f2 | g2 | h2 | i2 | j2 |
| 3 | a3 | b3 | c3 | d3 | e3 | f3 | g3 | h3 | i3 | j3 |
| 4 | a4 | b4 | c4 | d4 | e4 | f4 | g4 | h4 | i4 | j4 |
| 5 | a5 | b5 | c5 | d5 | e5 | f5 | g5 | h5 | i5 | j5 |
| 6 | a6 | b6 | c6 | d6 | e6 | f6 | g6 | h6 | i6 | j6 |
| 7 | a7 | b7 | c7 | d7 | e7 | f7 | g7 | h7 | i7 | j7 |
| 8 | a8 | b8 | c8 | d8 | e8 | f8 | g8 | h8 | i8 | j8 |
| 9 | a9 | b9 | c9 | d9 | e9 | f9 | g9 | h9 | i9 | j9 |
| 10 | a10 | b10 | c10 | d10 | e10 | f10 | g10 | h10 | i10 | j10 |
| 11 | a11 | b11 | c11 | d11 | e11 | f11 | g11 | h11 | i11 | j11 |
| 12 | a12 | b12 | c12 | d12 | e12 | f12 | g12 | h12 | i12 | j12 |

37

DATA HAVING UNDERGONE SLANT CORRECTION (HEAD SLANT $\theta_1$ FOR CORRECTION AMOUNT A)

| | D | E |
|---|---|---|
| 1 | d1 | e1 |
| 2 | d2 | e2 |
| 3 | d3 | e3 |
| 4 | d4 | e4 |
| 5 | d5 | f5 |
| 6 | d6 | f6 |
| 7 | e7 | f7 |
| 8 | e8 | f8 |
| 9 | e9 | g9 |
| 10 | e10 | g10 |
| 11 | e11 | g11 |
| 12 | e12 | g12 |

FIG. 3B

| | a | b | c | d | e | f | g | h | i | j |
|---|---|---|---|---|---|---|---|---|---|---|
| 1 | a1 | b1 | c1 | d1 | e1 | f1 | g1 | h1 | i1 | j1 |
| 2 | a2 | b2 | c2 | d2 | e2 | f2 | g2 | h2 | i2 | j2 |
| 3 | a3 | b3 | c3 | d3 | e3 | f3 | g3 | h3 | i3 | j3 |
| 4 | a4 | b4 | c4 | d4 | e4 | f4 | g4 | h4 | i4 | j4 |
| 5 | a5 | b5 | c5 | d5 | e5 | f5 | g5 | h5 | i5 | j5 |
| 6 | a6 | b6 | c6 | d6 | e6 | f6 | g6 | h6 | i6 | j6 |
| 7 | a7 | b7 | c7 | d7 | e7 | f7 | g7 | h7 | i7 | j7 |
| 8 | a8 | b8 | c8 | d8 | e8 | f8 | g8 | h8 | i8 | j8 |
| 9 | a9 | b9 | c9 | d9 | e9 | f9 | g9 | h9 | i9 | j9 |
| 10 | a10 | b10 | c10 | d10 | e10 | f10 | g10 | h10 | i10 | j10 |
| 11 | a11 | b11 | c11 | d11 | e11 | f11 | g11 | h11 | i11 | j11 |
| 12 | a12 | b12 | c12 | d12 | e12 | f12 | g12 | h12 | i12 | j12 |

DATA HAVING UNDERGONE SLANT CORRECTION (HEAD SLANT $\theta_2$ FOR CORRECTION AMOUNT B)

| | D | E |
|---|---|---|
| 1 | d1 | e1 |
| 2 | d2 | e2 |
| 3 | d3 | e3 |
| 4 | d4 | e4 |
| 5 | e5 | e5 |
| 6 | e6 | e6 |
| 7 | e7 | f7 |
| 8 | e8 | f8 |
| 9 | f9 | f9 |
| 10 | f10 | f10 |
| 11 | f11 | f11 |
| 12 | f12 | f12 |

38

FIG. 8A

BUFFER DATA

| | a | b | c | d | e | f | g | h | i | j |
|---|---|---|---|---|---|---|---|---|---|---|
| 1 | a1 | b1 | c1 | d1 | e1 | f1 | g1 | h1 | i1 | j1 |
| 2 | a2 | b2 | c2 | d2 | e2 | f2 | g2 | h2 | i2 | j2 |
| 3 | a3 | b3 | c3 | d3 | e3 | f3 | g3 | h3 | i3 | j3 |
| 4 | a4 | b4 | c4 | d4 | e4 | f4 | g4 | h4 | i4 | j4 |
| 5 | a5 | b5 | c5 | d5 | e5 | f5 | g5 | h5 | i5 | j5 |
| 6 | a6 | b6 | c6 | d6 | e6 | f6 | g6 | h6 | i6 | j6 |
| 7 | a7 | b7 | c7 | d7 | e7 | f7 | g7 | h7 | i7 | j7 |
| 8 | a8 | b8 | c8 | d8 | e8 | f8 | g8 | h8 | i8 | j8 |
| 9 | a9 | b9 | c9 | d9 | e9 | f9 | g9 | h9 | i9 | j9 |
| 10 | a10 | b10 | c10 | d10 | e10 | f10 | g10 | h10 | i10 | j10 |
| 11 | a11 | b11 | c11 | d11 | e11 | f11 | g11 | h11 | i11 | j11 |
| 12 | a12 | b12 | c12 | d12 | e12 | f12 | g12 | h12 | i12 | j12 |

*NUMBER OF NOZZLES IN NOZZLE ARRAY→12

FIG. 8B

TRANSFER DATA (FIRST SCANNING)

| | A | B | C | D | E | F | G | H | I | J | K | L |
|---|---|---|---|---|---|---|---|---|---|---|---|---|
| 1 | a1 | b1 | c1 | d1 | e1 | f1 | g1 | h1 | i1 | j1 | | |
| 2 | a2 | b2 | c2 | d2 | e2 | f2 | g2 | h2 | i2 | j2 | | |
| 3 | a3 | b3 | c3 | d3 | e3 | f3 | g3 | h3 | i3 | j3 | | |
| 4 | | | c4 | d4 | e4 | f4 | g4 | | | | | |
| 5 | | | | d5 | e5 | f5 | | | | | | |
| 6 | | a6 | b7 | d6 | e6 | f6 | | | | i6 | j6 | |
| 7 | | a7 | b8 | | e7 | | | | h7 | i7 | j7 | |
| 8 | | | b9 | | e8 | | | | h8 | | | |
| 9 | | | | c9 | e9 | | | g9 | h9 | | | |
| 10 | | | a10 | c10 | e10 | | | g10 | | | i10 | j10 |
| 11 | | | a11 | c11 | e11 | | | g11 | | | i11 | j11 |
| 12 | | | a12 | c12 | e12 | | | g12 | | | i12 | j12 |

| | | | | | | | | | |
|---|---|---|---|---|---|---|---|---|---|
| 2 | 1.5 | 1 | 0.5 | 0 | 0.5 | 1 | 1.5 | 2 | 2 |

SLANT CORRECTION AMOUNT

FIG. 8C

TRANSFER DATA (SECOND SCANNING)

| | A | B | C | D | E | F | G | H | I | J | K | L |
|---|---|---|---|---|---|---|---|---|---|---|---|---|
| 1 | | | | | | | | | | | | |
| 2 | | | | | | | | | | | | |
| 3 | | | | | | | | | | | | |
| 4 | a4 | b4 | | | | | | h4 | i4 | j4 | | |
| 5 | a5 | b5 | c5 | | | | g5 | h5 | i5 | j5 | | |
| 6 | | b6 | c6 | | | | g6 | h6 | | | | |
| 7 | | | c7 | d7 | | f7 | g7 | | | | | |
| 8 | | a8 | c8 | d8 | | f8 | g8 | | | i8 | j8 | |
| 9 | | a9 | | d9 | | f9 | | | | i9 | j9 | |
| 10 | | | b10 | d10 | | f10 | | | h10 | | | |
| 11 | | | b11 | d11 | | f11 | | | h11 | | | |
| 12 | | | b12 | d12 | | f12 | | | h12 | | | |

| | | | | | | | | | |
|---|---|---|---|---|---|---|---|---|---|
| 2 | 1.5 | 1 | 0.5 | 0 | 0.5 | 1 | 1.5 | 2 | 2 |

SLANT CORRECTION AMOUNT

PRINTING APPARATUS AND PRINTING METHOD

BACKGROUND OF THE INVENTION

1. Field of the Invention

The present invention relates to a printing apparatus and a printing method, particularly to a printing apparatus which prints an image by discharging ink onto a print medium while reciprocally moving a carriage which mounts an inkjet printhead, and a printing method used by the apparatus.

2. Description of the Related Art

In image printing by an inkjet printing apparatus (to be referred to as a printing apparatus hereinafter), a high-quality image cannot be obtained unless a plurality of ink droplets which form the image land at correct positions on a print medium (for example, a printing sheet) to form dots in a relatively correct array. However, variations occur in landing position of dots due to various errors generated in the printing apparatus.

In a printing apparatus which prints on a print medium while scanning a printhead which is mounted to a carriage, the scanning direction of the carriage must be perpendicular to the nozzle array direction of the printhead. However, due to factors associated with, for example, the nozzle manufacturing accuracy of the printhead, and a tolerance upon mounting the printhead on the carriage, the nozzle array direction may not be perpendicular to the carriage scanning direction. If the perpendicular relationship cannot be obtained, the actual nozzle array direction with respect to the expected direction will be referred to as a head slant hereinafter.

FIG. 13 shows views of the relationship between the head slant and the formed image.

b in FIG. 13 shows the case wherein no head slant is present, a in FIG. 13 shows the case wherein a head slant is in the obliquely lower left direction, and c in FIG. 13 shows the case wherein a head slant is in the obliquely lower right direction. As can be seen from comparisons among these three drawings, even when printing is similarly done on a printing sheet 3 by a nozzle array 10 of a printhead 9 (the vertical ruled line in this example), printing is normally done in the absence of a head slant, but printing is not correctly done in the presence of a head slant. Such a slant derives from, for example, a shift between the nozzle array direction and the carriage scanning direction upon mounting the printhead on the carriage, or bending of a main rail 8 provided for carriage scanning.

A method of setting an address management unit for reading out printing data, corresponding to the head slant, according to this slant, and setting the value of the head slant to be corrected for the address management unit has been conventionally proposed (see, for example, Japanese Patent Laid-Open No. 2004-009489).

FIG. 14 shows views of the concept of slant correction according to the conventional technique.

d in FIG. 14 shows printing data stored in a print buffer, and e in FIG. 14 is a schematic view showing the timing at which slant correction is performed to print on a print medium. An example in which slant correction is done at positions corresponding to printing data on columns a, f, and j stored in the print buffer will be described with reference to FIG. 14. FIG. 14 shows an example where slant correction of 2 columns is performed for column a, slant correction of 1 column is performed for column f, and slant correction is not performed for column j. In conventional slant correction, as shown in e of FIG. 14, printing data on column a is read from the print buffer so as to be printed at a printing timing corresponding to three columns A to C. Also, printing data on column f is read from the print buffer so as to be printed at a printing timing corresponding to 2 columns F and G, and that on column j is read from the print buffer so as to be printed at a printing timing corresponding to 1 (one) column J.

With this operation, by printing while changing a timing at which printing data is read from the print buffer in accordance with the head slant, the slant of printing dots formed on the print medium is corrected, thus allowing printing free from any slant.

However, in the case of slant correction in the above-mentioned conventional example, when the timing of reading from the print buffer is changed for each carriage position, data may not be completely read, resulting in local loss of an image.

SUMMARY OF THE INVENTION

Accordingly, the present invention is conceived as a response to the above-described disadvantages of the conventional art.

For example, a printing apparatus and a printing method according to this invention is capable of satisfactorily printing over the entire printing image region even when there is a slant between the nozzle array direction of a printhead and the carriage scanning direction.

According to one aspect of the present invention, there is provided a printing apparatus which prints by discharging ink from a plurality of nozzles onto a print medium while reciprocally scanning a carriage, which mounts a printhead on which the plurality of nozzles are arrayed, in a direction different from a direction in which the plurality of nozzles are arrayed, the apparatus comprising: an obtaining unit configured to obtain a slant between the direction in which the nozzles are arrayed, and a moving direction of the carriage, for each position corresponding to a printing column in the moving direction of the carriage; a print buffer configured to store image data in association with the printing column; a detection unit configured to detect a position of the carriage; a reading unit configured to read image data corresponding to the printing column stored in the print buffer by separating the image data into image data used for printing by first scanning of the printhead, and image data used for printing by second scanning of the printhead in a same region as that in which printing is done by the first scanning, based on the position of the carriage detected by the detection unit and the slant in the position of the carriage corresponding to the printing column obtained by the obtaining unit; and a control unit configured to control the printhead so as to print by scanning the same region by the first scanning and the second scanning, using the image data read by the reading unit.

According to another aspect of the present invention, there is provided a printing method in a printing apparatus which prints by discharging ink from a plurality of nozzles onto a print medium while reciprocally scanning a carriage, which mounts a printhead on which the plurality of nozzles are arrayed, in a direction different from a direction in which the plurality of nozzles are arrayed, comprising: obtaining a slant between the direction in which the nozzles are arrayed, and a moving direction of the carriage, for each position corresponding to a printing column in the moving direction of the carriage; detecting a position of the carriage; reading image data corresponding to the printing column stored in a print buffer in association with each printing column by separating the image data into image data used for printing by first scanning of the printhead, and image data used for printing by second scanning of the printhead in a same region as that in which printing is done by the first scanning, based on the detected position of the carriage and the slant in the set position of the carriage corresponding to the printing column; and controlling the printhead so as to print by scanning the same region by the first scanning and the second scanning, using the read image data.

The invention is particularly advantageous since satisfactory printing can be achieved in the entire printing image region even when there is a slant between the nozzle array direction of a printhead and the carriage scanning direction.

Further features of the present invention will become apparent from the following description of exemplary embodiments with reference to the attached drawings.

BRIEF DESCRIPTION OF THE DRAWINGS

FIGS. 3A and 3B are tables schematically showing the state where conventional slant correction is performed for a change in slant for each column position along the carriage moving direction.

FIGS. 8A, 8B, and 8C are data allocations schematically showing the state where head slant correction is applied in the entire carriage scanning region.

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "print element" generically means an ink orifice or a liquid channel communicating with it, and an element for generating energy used to discharge ink, unless otherwise specified.

<General Outline of Printing Apparatus (FIGS. 1 and 2)>

Figure 1:
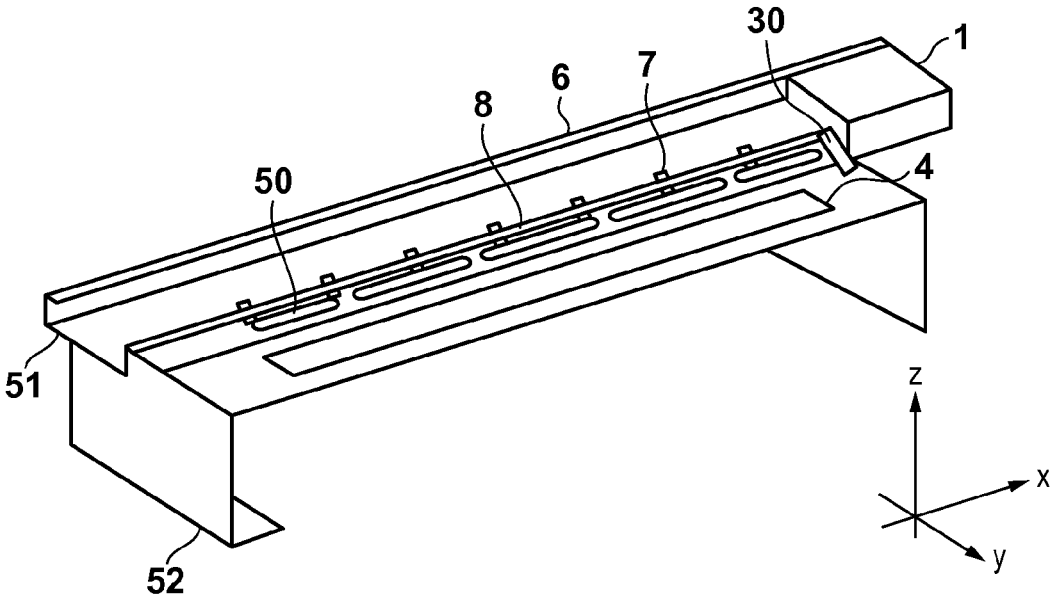
FIG. 1 is an external perspective view of an inkjet printing apparatus according to an exemplary embodiment of the present invention.

FIG. 1 is an external perspective view of an inkjet printing apparatus (to be referred to as a printing apparatus hereinafter) capable of color printing according to an exemplary embodiment of the present invention. Note that FIG. 1 shows the state where a front cover is removed to expose the interior of the apparatus. Also, to represent the three-dimensional direction, FIG. 1 shows the X-, Y-, and Z-axes orthogonal to each other.

In the printing apparatus, a printhead (not shown) mounted on a carriage 1 is reciprocally scanned along the X-direction (main scanning direction) using a carriage motor (not shown). Movement in the main scanning direction is done by transferring the power of the carriage motor through a carriage belt (not shown). Also, the movement is performed by guiding the carriage 1 while a main rail 8 and sub-rail 6 disposed parallel to the main scanning direction support the carriage 1. Note that the main rail 8 is attached to the printing apparatus by a support member 7.

The main rail 8, sub-rail 6, and front cover, for example, are attached to an upper housing 51 of the printing apparatus. On the other hand, a platen 4 and conveyance roller (not shown), for example, are attached to a lower housing 52. Note that mist suction holes 50 for collecting mist that results from ink discharge upon discharging ink from a plurality of nozzles of a printhead are formed in the lower housing 52.

The printhead is supplied with ink from ink tanks which contain inks of black, cyan, magenta, yellow, and discharges each ink to print. Also, a reflective optical sensor 30 is disposed on the carriage 1, and is used to detect the density of an adjustment pattern printed on a print medium, and for edge detection of the print medium. To detect the dot formation position shift amount on the print medium, the printing sheet is conveyed in the sub-scanning direction while moving the carriage in the main scanning direction, thereby allowing the reflective optical sensor 30 to detect the density of an adjustment pattern formed on the printing sheet.

Although not shown in FIG. 1, a print medium such as a printing sheet is conveyed along the Y-axis (sub-scanning direction) in synchronism with the movement of the carriage 1.

Figure 2:
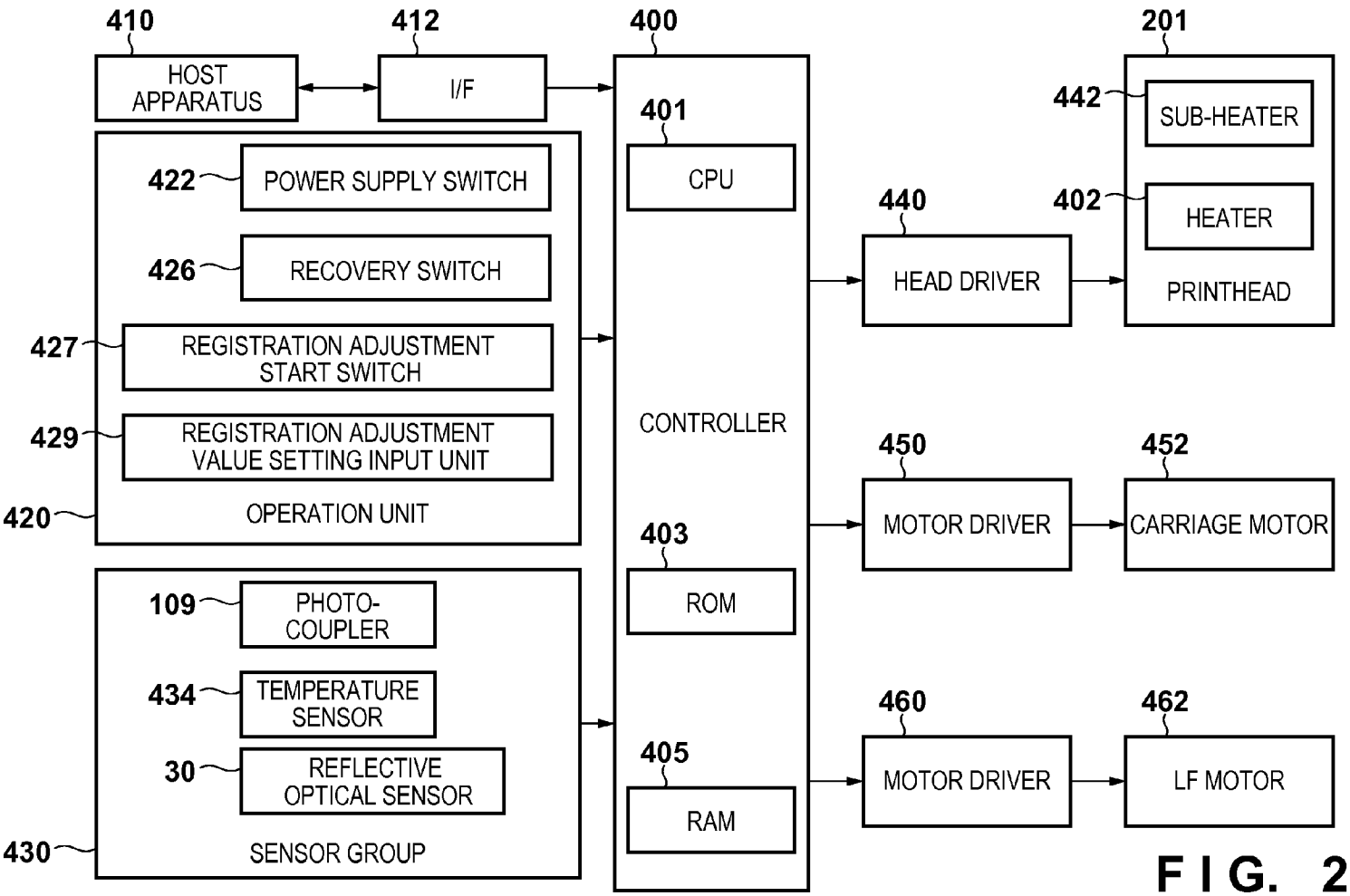
FIG. 2 is a schematic block diagram showing the control configuration of the printing apparatus shown in FIG. 1.

FIG. 2 is a schematic block diagram showing the control configuration of the printing apparatus shown in FIG. 1.

Referring to FIG. 2, a controller 400 includes, for example, a CPU 401 in the form of a microprocessor, a ROM 403 which stores a program, a required table, and other permanent data, and a RAM 405 used as, for example, the expansion area of image data or the working area. Image data, other commands, and status signals, for example, are transmitted/received via an interface (I/F) 412 between the controller 400 and a host apparatus 410 serving as an image data supply source.

Note that the host apparatus 410, more specifically, adopts various forms including not only a computer but also an image reading scanner and digital camera which perform, for example, generation and processing of data of, for example, an image associated with printing.

An operation unit 420 is provided with various switches which accept input of an instruction from the user. These switches include, for example, a power supply switch 422, a recovery switch 426 for instructing startup of suction recovery, and a registration adjustment start switch 427 for manual registration adjustment, and a registration adjustment value setting input unit 429 for manually inputting the adjustment value.

A sensor group 430 includes various sensors for detecting the apparatus state, and includes, for example, the above-mentioned reflective optical sensor 30, a photo-coupler 109 for detecting a home position, and a temperature sensor 434 provided in an appropriate portion for detecting the environmental temperature.

A head driver 440 drives a plurality of heaters (printing elements) of a printhead 201 in accordance with, for example, image data. The head driver 440 includes a shift register which aligns image data in correspondence with the heater position, and a latch circuit which latches the image data at an appropriate timing. The head driver 440 also includes not only a logic circuit element which drives a heater in synchronism with a driving timing signal, but also a timing setting unit which appropriately sets the driving timing (discharge timing) for dot formation alignment.

The printhead 201 includes not only a plurality of heaters 402 but also a sub-heater 442. The sub-heater 442 is used for temperature adjustment for stabilizing the ink discharge characteristics. The sub-heater 442 may adopt any of a configuration in which it is formed on the same head substrate as the heaters 402, that in which it is attached to the printhead main body or head cartridge, or that in which these configurations are combined with each other.

A motor driver 450 serves as a driver which drives a carriage motor 452, and a motor driver 460 drives an LF motor 462 used to convey a print medium in the sub-scanning direction.

<Slant Correction>

A case where head slant correction in the carriage scanning region is executed using slant correction according to the conventional technique will be described for the sake of comparison first.

1. Description of Comparative Example According to Conventional Technique

Figure 14:
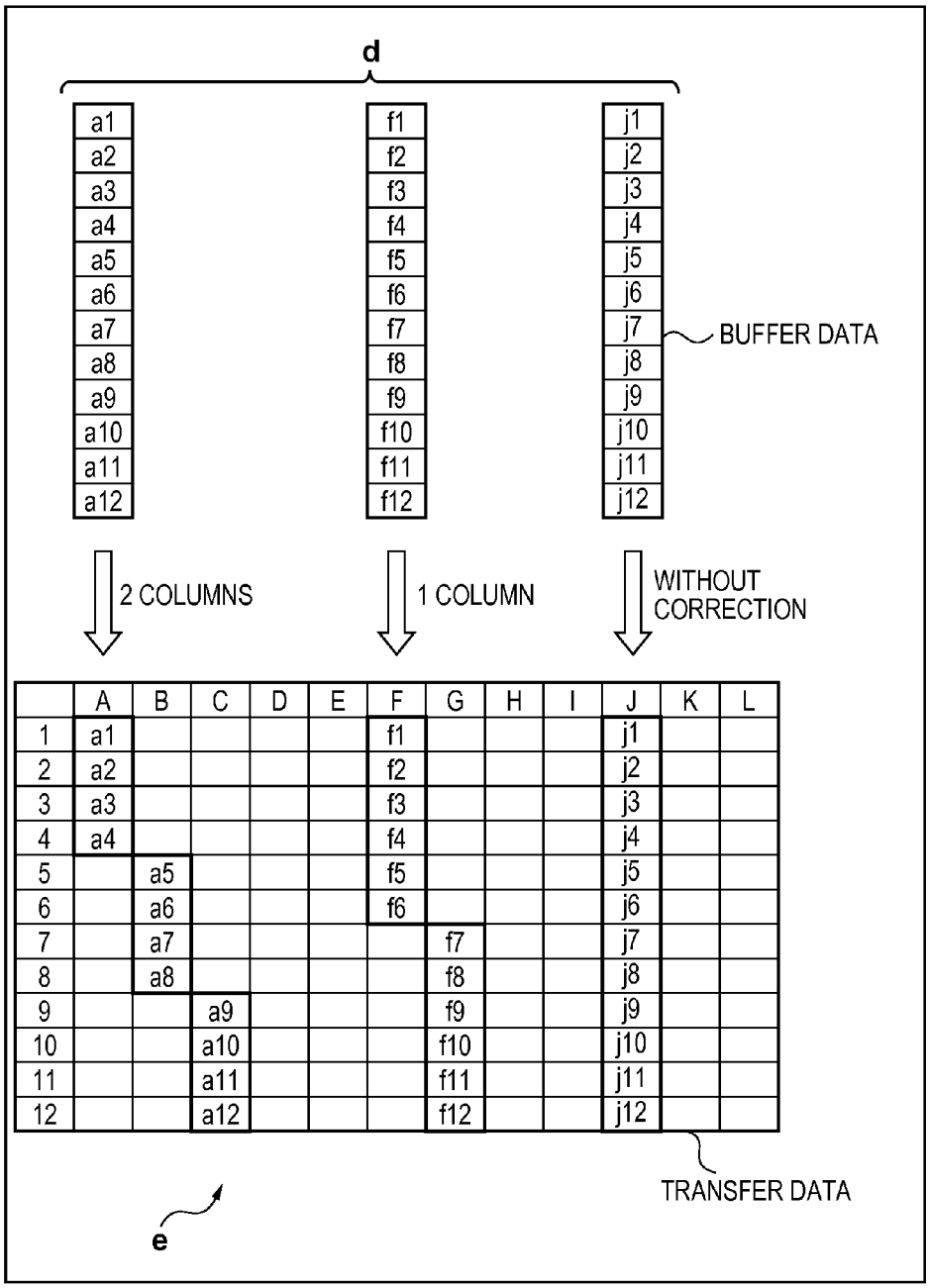
FIG. 14 is a view showing the concept of slant correction according to the conventional technique.

FIGS. 3A and 3B are views schematically showing the states where conventional slant correction is executed for a slant change for each column position along the carriage moving direction. This correction method is the same as that described in the details of the conventional technique with reference to FIG. 14.

When the slant correction amount changes for each column position of the carriage, correction of 1 column at a carriage position corresponding to column d, and 2 columns at a carriage position corresponding to column e are necessary in an example of FIG. 3A. In this case, as data printed at the printing timing of column D, data of rows 1 to 6 on column d, and data of rows 7 to 12 on column e are read. Also, as data printed at the printing timing of column E, data of rows 1 to 4 on column e, rows 5 to 8 on column f, and rows 9 to 12 on column g are read. When correction is performed in this way, data present on rows 5 and 6 on column e, and on rows 9 to 12 on column f cannot be read and used for printing, so a faulty image region occurs. Referring to FIG. 3A, the region 37 represents a faulty image.

Also, FIG. 3B shows the case where correction of 2 columns at a carriage position corresponding to column d, and 1 column at a carriage position corresponding to column e are necessary. In this case, as data printed at the printing timing of column D, data of rows 1 to 4 on column d, rows 5 to 8 on column e, and rows 9 to 12 on column f are read. As data printed at the printing timing of column E, data of rows 1 to 6 on column e, and rows 7 to 12 on column f are read. In this case, data of rows 5 and 6 on column j, and rows 9 to 12 on column k are read twice, so duplicate printing is done. Referring to FIG. 3B, the region 38 represents two duplicate printing operations of an image.

In all cases as well, a desired image cannot be printed.

To solve the problem in the conventional technique so as to execute printing that causes neither a faulty image nor image duplicate printing, head slant correction is executed in the following carriage scanning region.

2. Head Slant Correction According to this Embodiment

Figure 4:
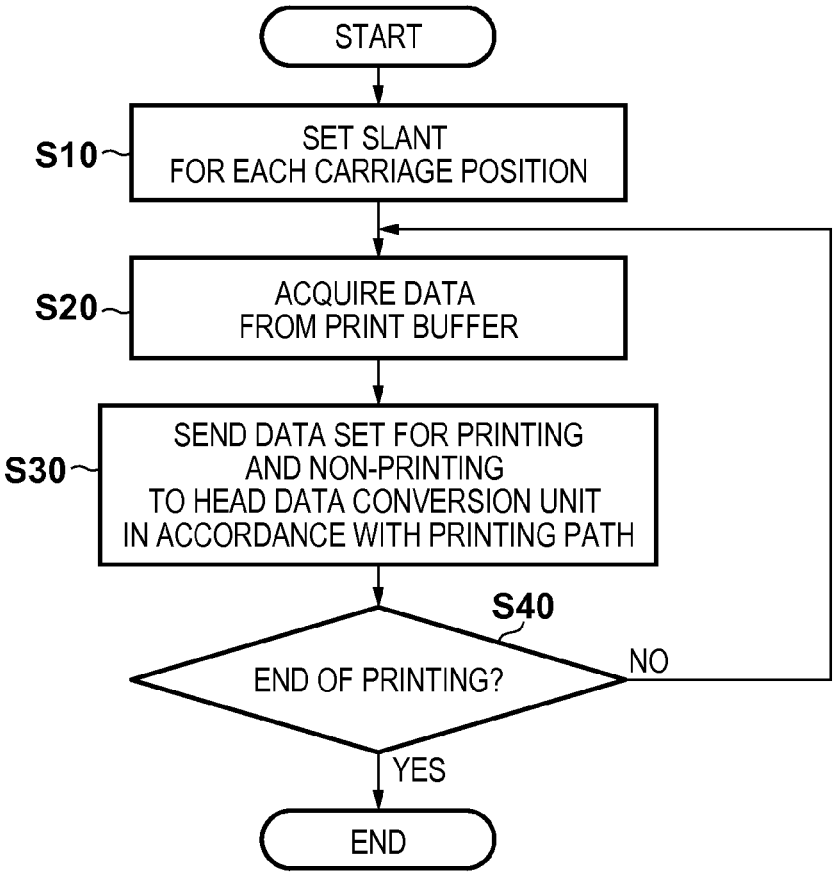
FIG. 4 is a flowchart showing head slant correction processing.

FIG. 4 is a flowchart showing head slant correction processing according to this embodiment.

In step S10, the slant for each column position in the carriage moving direction is set.

Figure 5:
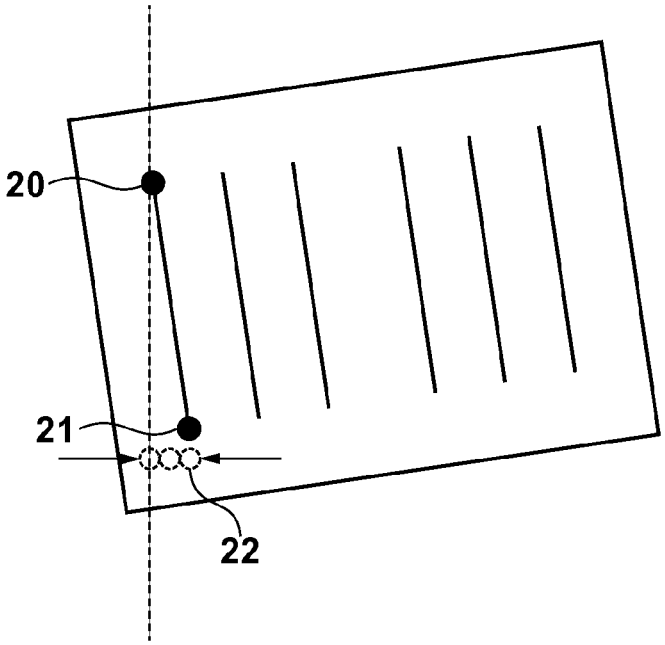
FIG. 5 is a schematic view showing the head slant state.

FIG. 5 is a schematic view showing the head slant state.

Note that FIG. 5 illustrates an example in which a printhead formed by 1,280 nozzles for each nozzle array is used. Referring to FIG. 5, reference numeral 20 denotes nozzle number (seg) 0; 21, seg1279 when seg0 is set as a reference for the axis of a printing sheet indicated by a broken line. As shown in FIG. 5, a space 22 in which 2 dots can be inserted with respect to the axis of a printing sheet is present in this example. In this case, correction slant information indicating that the nozzle array direction shifts by 2 columns in the carriage moving direction is input. That is, in step S10, the shift amount (correction slant information) is stored for each column position in the carriage moving direction.

The correction slant information is obtained by detecting the degree of shift of the nozzles at the two ends of the printhead by simultaneously reading a specific pattern using the optical sensor 30 provided in the carriage 1 while printing the pattern on a print medium from the printhead.

In step S20, image data is acquired from the print buffer.

Figure 6:
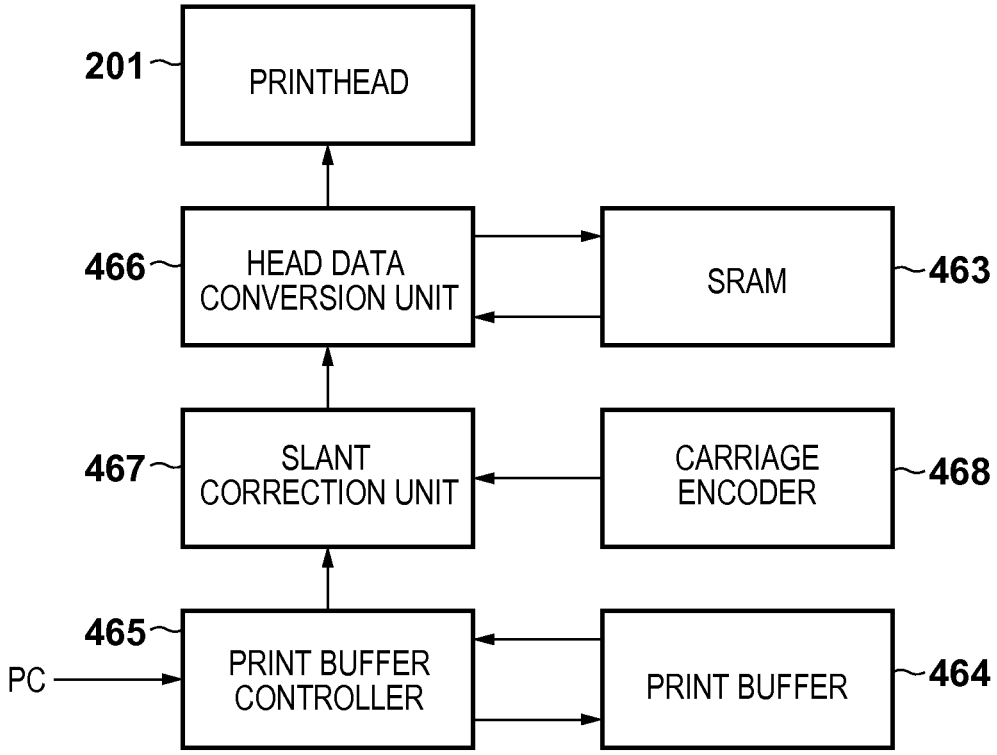
FIG. 6 is a functional block diagram showing the internal configuration of a print buffer controller implemented by a controller, and its peripheral units.

FIG. 6 is a functional block diagram showing the internal configuration of a print buffer controller implemented by the controller 400, and its peripheral unit.

Image data transmitted from the host apparatus 410 is processed by the CPU 401 of the printing apparatus, and input to a print buffer controller 465. The print buffer controller 465 stores the processed image data in a print buffer 464 until the printing start timing.

In accordance with the printing timing, image data is transferred from the print buffer 464 to a slant correction unit 467. At this time, the slant correction unit 467 synchronizes position information associated with the main scanning direction of the carriage 1 from a carriage encoder 468 with slant data at that position to execute slant correction.

Image data having undergone slant correction is transferred to a head data conversion unit 466. The head data conversion unit 466 converts the image data into a printing data signal suitable for the printhead, and transfers it to the printhead 201. Note that a printing data signal is transferred to the printhead 201 in synchronism with movement of the carriage 1 to execute appropriate printing.

In this embodiment, processing corresponding to slant data is executed at the timing at which image data stored in the print buffer 464 is transferred to the slant correction unit 467 and head data conversion unit 466.

First, correction slant information is stored in the print buffer controller 465. In synchronism with printing, image data for next scanning printing is acquired from the print buffer 464. Based on the correction slant information, the acquired image data is masked to determine the address location and reading timing at which reading is done.

Masking is done by applying $$\text{Nozzle Number(seg)}\times(1/(\text{Number of All Nozzles})\times \text{Correction Slant Information}\times 2 \quad (1)$$

to each nozzle.

When, for example, the number of nozzles is 1,280, the printing resolution and nozzle resolution are 1,200 dpi, and the input correction slant information is 2 dots (1,200 dpi), equation (1) can be rewritten as:

$$\text{Nozzle Number(seg)}\times(1/1280)\times 2\times 2 \quad (2)$$

Note that as shown with reference to FIG. 5, correction slant information of 2 dots means that seg1279 shifts by 2 dots with respect to seg0.

The result of rounding the first decimal place of the result obtained using the above-mentioned equation is divided by two. Mask processing is performed for image data with no remainder so as to print in first scanning, while mask processing is performed for image data with a remainder so as to print in second scanning. Also, the shift amount of the address location at which data read is performed in accordance with the value (n) of the integral part of the quotient is determined.

If n=0, the address location is not shifted. If n=1, the reading position of image data is shifted in the main scanning direction by 1 bit (that is, by 1 column). Similarly, if n=2, the reading position of image data is shifted in the main scanning direction by 2 bits (that is, by 2 columns). With the same processing, the reading position of image data is shifted to the negative side if this data has a negative value. Therefore, when the input correction slant information is 2 dots (1,200 dpi), the following information is obtained. That is, with respect to the nozzle number (seg), seg0~seg 159: Value (n) of Integral Part 0, Remainder 0
seg160~seg 479: Value (n) of Integral Part 0, Remainder 1
seg480~seg 799: Value (n) of Integral Part 1, Remainder 0
seg800~seg 1119: Value (n) of Integral Part 1, Remainder 1
seg1120~seg 1279: Value (n) of Integral Part 2, Remainder 0

That is, image data is divided as:

seg0~seg 159: Shift 0, Printing by First Scanning
seg160~seg 479: Shift 0, Printing by Second Scanning
seg480~seg 799: Shift 1, Printing by First Scanning
seg800~seg 1119: Shift 1, Printing by Second Scanning
seg1120~seg 1279: Shift 2, Printing by First Scanning In step S30, image data for which print and no-print are set in accordance with the printing pass are transferred to the head data conversion unit 466.

Figure 7A:
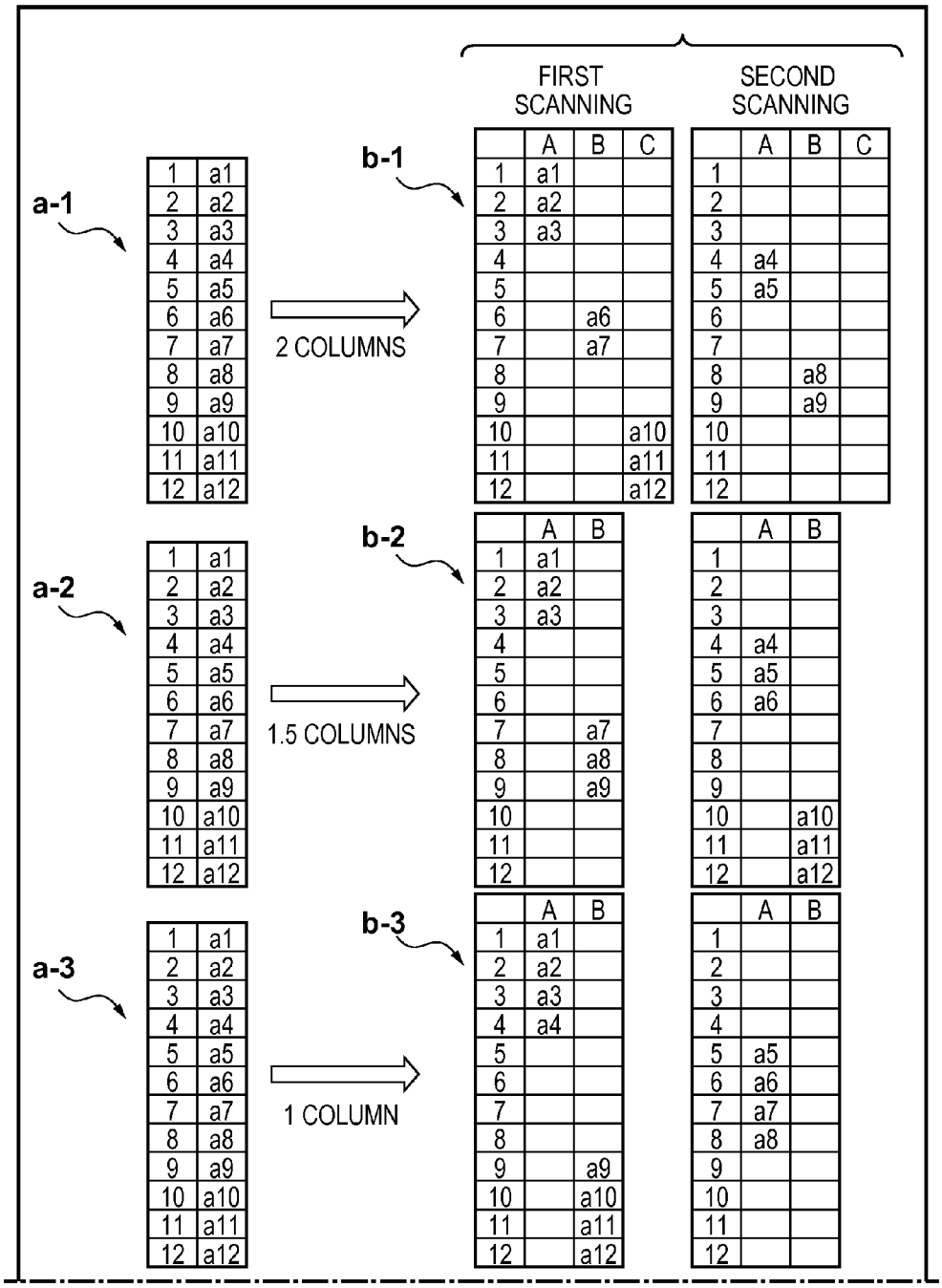
FIGS. 7A and 7B are views schematically showing an image shift in specific position of the carriage moving direction.
Figure 7B:
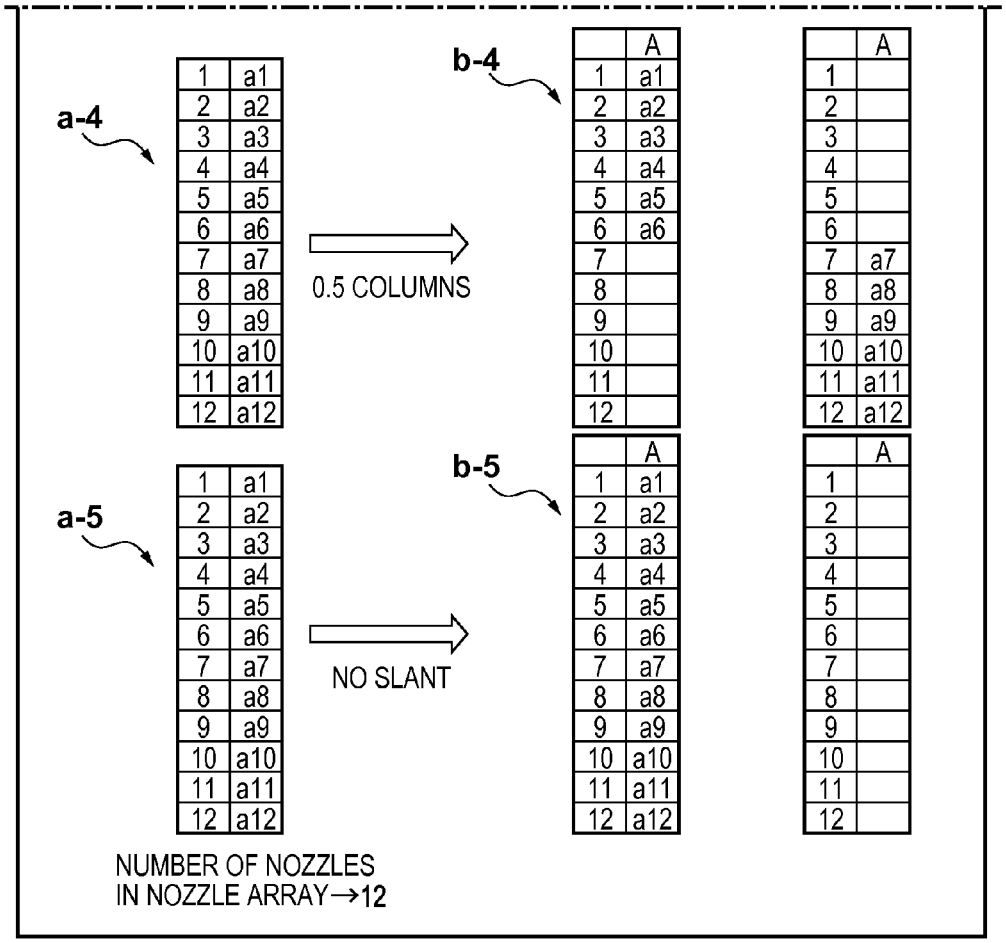

FIGS. 7A and 7B are views schematically showing the timing at which image data of 1 column is read.

a-1 to a-5 in FIGS. 7A and 7B are views showing image data before slant correction acquired from the print buffer, and b-1 to b-5 in FIGS. 7A and 7B are views showing data printed by first scanning, and that printed by second scanning after slant correction. In this case, FIGS. 7A and 7B show the case where there are shift amounts of 2 columns, 1.5 columns, 1 column, 0.5 columns, and 0.5 columns, for the sake of description. Note that image data corresponding to each pixel stored in the print buffer has its reading position (reading address) specified by the row and column addresses of the buffer.

As for image data on column a when slant correction of 2 columns is performed, in first scanning, data of rows 1 to 3 on column a is printed at the timing of column A, data of rows 6 and 7 on column a is printed at the timing of column B, and data of rows 10 to 12 on column a is printed at the timing of column C, as shown in b-1 of FIG. 7A. In second scanning, data of rows 4 and 5 on column a is printed at the timing of column A, and data of rows 8 and 9 on column a is printed at the timing of column B.

As for image data on column a when slant correction of 1.5 columns is performed, in first scanning, data of rows 1 to 3 on column a is printed at the timing of column A, and data of rows 7 to 9 on column a is printed at the timing of column B, as shown in b-2 of FIG. 7A. In second scanning, data of rows 4 to 6 on column a is printed at the timing of column A, and data of rows 10 to 12 on column a is printed at the timing of column B.

As for image data on column a when slant correction of 1 column is performed, in first scanning, data of rows 1 to 4 on column a is printed at the timing of column A, and data of rows 9 to 12 on column a is printed at the timing of column B, as shown in b-3 of FIG. 7A. In second scanning, data of rows 5 to 8 on column a is printed at the timing of column A.

As for image data on column a when slant correction of 0.5 columns is performed, in first scanning, data of rows 1 to 6 on column a is printed at the timing of column A, as shown in b-4 of FIG. 7B. In second scanning, data of rows 7 to 12 on column a is printed at the timing of column A.

When slant correction is not performed, all data are printed at the timing of column A in first scanning, as shown in b-5 of FIG. 7B.

FIGS. 8A to 8C are views schematically showing the states where image data in first scanning, and that in second scanning are divided by applying head slant correction in the entire carriage scanning region.

FIG. 8A is a view showing image data of the print buffer, and FIGS. 8B and 8C are views showing data printed by first scanning, and that printed by second scanning after slant correction.

For example, at the printing timing of column C in first scanning, image data of rows 1 to 4 on column c, image data of rows 7 to 9 on column b, and image data of rows 10 to 12 on column a are read from the print buffer and printed. Also, at the printing timing of column C in second scanning, image data of rows 5 to 8 on column c, and image data of rows 10 to 12 on column b are read from the print buffer and printed.

With this arrangement, image data used for printing in first scanning, and that used for printing in second scanning are divided based on Expression (1). After the printing operation of image data in first scanning, image data of second scanning is printed in the same region on the print medium so as to print an image having undergone head slant correction in the carriage scanning region on the print medium. Also, image data is distributed based on Expression (1) to remove image data that is not used for printing, or that repeatedly used for printing.

Note that to acquire image data, data may be thinned for first scanning and second scanning, or mask processing of selecting printing/non-printing may be executed for the acquired data. The same result is obtained when either processing is executed.

Also, in this embodiment, in calculation for obtaining the above-mentioned remainder, first scanning and second scanning are performed for values of 0 and 1, but the present invention does not specify this order.

Lastly, it is checked in step S40 whether or not printing is to end, and if printing is to continue, the process returns to step S20, in which the similar correction printing is executed until it is determined that printing is to end.

According to the above-mentioned embodiment, a shift of the dot formation position due to head slant can be improved in the entire carriage scanning region.

Note that in the above-mentioned embodiment, image data is divided into printing data for first scanning, and that for second scanning to complete printing by scanning twice for the same region so as to perform slant correction for each carriage printing column position with no need for memory addition.

<Other Embodiments>

In the above-mentioned embodiments, slant correction is executed at each printing column position in the carriage moving direction. However, in the above-mentioned embodiment, the printing positions in first scanning and second scanning by the printhead are not shifted in the main scanning direction. Hence, an example in which printing is performed by shifting the printing position in first scanning and second scanning by a half of the printing resolution in the main scanning direction will be described in this embodiment.

To print an image by shifting the printing resolution by a half in the main scanning direction, in this embodiment, a heat pulse signal generated from input carriage position information (encoder signal) is used.

Figure 9:
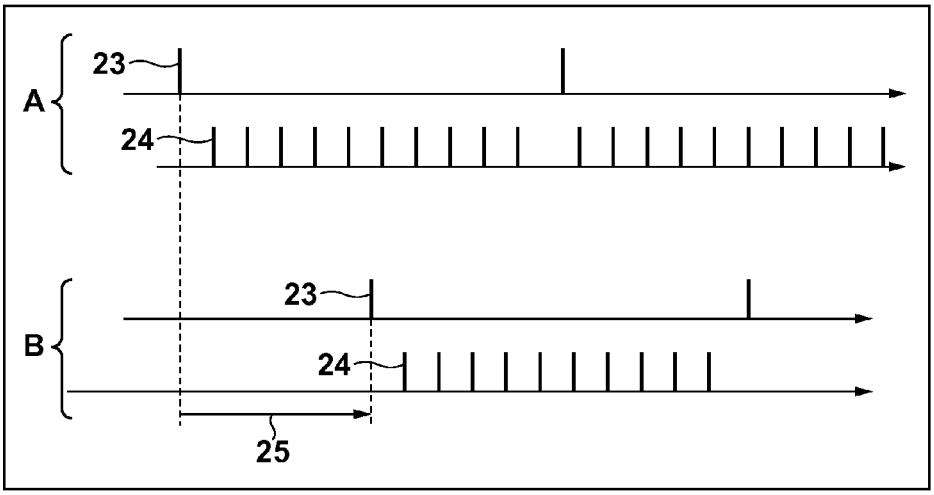
FIG. 9 is a view showing the concept of the ink discharge timing in a printing operation.

FIG. 9 is a view conceptually showing the ink discharge timing in the printing operation. A in FIG. 9 shows the discharge timing in first scanning of the printhead, and B in FIG. 9 shows the discharge timing in second scanning of the printhead.

As shown in A and B of FIG. 9, a heat pulse signal 23 is generated from carriage position information (encoder signal) input at a given timing. The period of the heat pulse signal corresponds to the printing resolution in the main scanning direction. A block trigger signal 24 for time division driving is generated from the generated heat pulse signal 23 to control the timing of ink discharge from the printhead in accordance with the block trigger signal.

The printing position (dot formation position) on the print medium can be shifted by shifting the discharge timings of first scanning and second scanning by a time period 25 corresponding to a half of the printing resolution with respect to the heat pulse signal 23. This makes it possible to set the resolution of slant correction higher than the printing resolution with no change in printing resolution.

Note that a method of printing by shifting the printing positions in first scanning and second scanning by a half of the printing resolution is not limited to the above-mentioned method. An example in which the generation timing of a block trigger signal generated from a heat pulse signal is changed to shift the dot formation position on the print medium will be described below.

Figure 10:
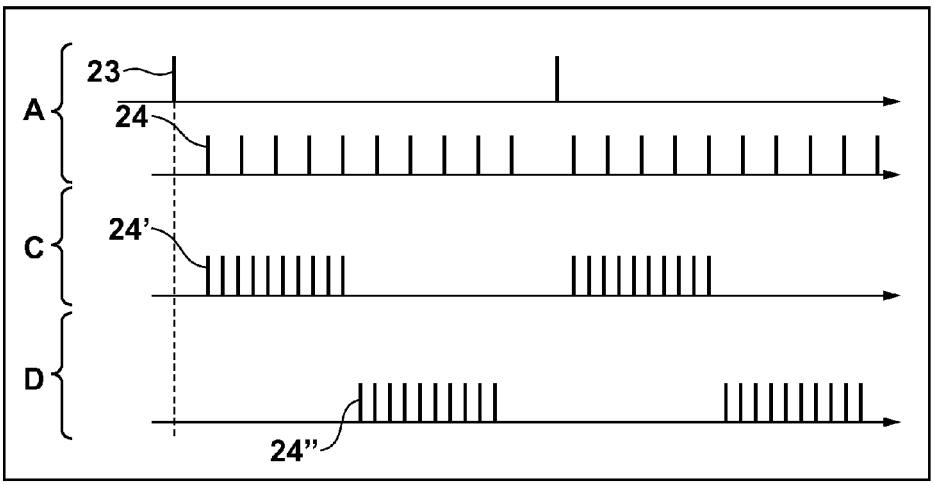
FIG. 10 is a view showing the concept of a change in timing at which a block trigger signal is generated.

FIG. 10 is a view conceptually showing a change in generation timing of a block trigger signal.

A in FIG. 10 shows the state where the period of the heat pulse signal 23 is divided into 10 subperiods to generate a block trigger signal 24, and is the same as A in FIG. 9. In normal printing, as shown in A of FIG. 10, a block trigger signal 24 is generated by using the entire region of one period interval of the heat pulse signal 23.

On the other hand, C in FIG. 10 is a view showing the generation timing of a block trigger signal 24' used for printing in first scanning. In this case, the block trigger signal 24' is generated within the time of the first half of one period of the heat pulse signal 23. The thus generated block trigger signal is generated at a time interval corresponding to a resolution half the printing resolution.

Again, D in FIG. 10 is a view showing the generation timing of a block trigger signal 24" used for printing in second scanning. In this case, the block trigger signal 24" is generated within the time of the second half of one period of the heat pulse signal 23. The thus generated block trigger signal is generated at a time interval corresponding to a resolution half the printing resolution.

As can be seen from a comparison between C and D in FIG. 10, printing in second scanning can be done on the print medium while the printing has shifted by a half of the printing resolution for printing in first scanning. This also makes it possible to set the slant correction resolution higher than the printing resolution without changing the printing resolution.

Figure 11:
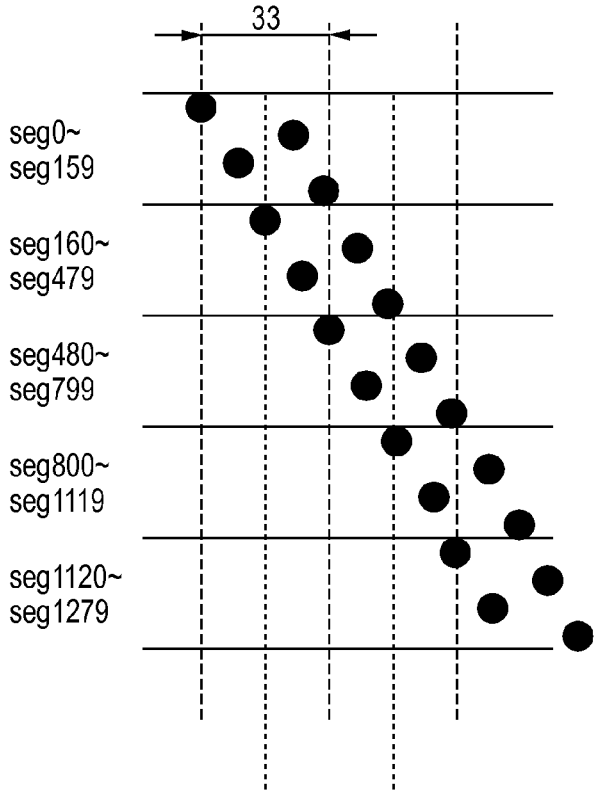
FIG. 11 is a view schematically showing the state where ink is discharged from a printhead to print, thereby forming dots.

FIG. 11 is a view schematically showing the state where ink is discharged from the printhead to print, thereby forming dots. In an example shown in FIG. 11, a block trigger signal is generated by using the entire region (printing resolution) of one period of the heat pulse signal 23 (A in FIG. 10), so each printing line width is the same as 1 column. Therefore, the width of the formed dot is equal to a width 33 corresponding to 1 column.

Figure 12:
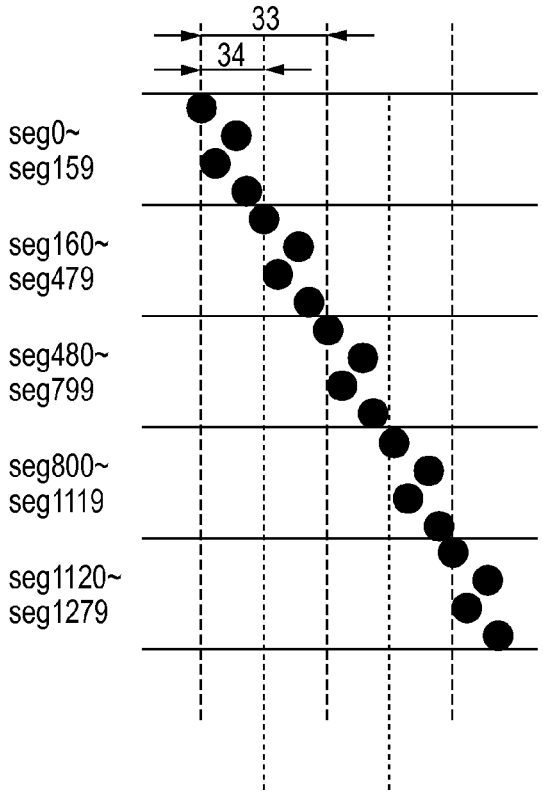
FIG. 12 is a view schematically showing the state where ink is discharged from the printhead to print, thereby forming dots when the generation timing of a block trigger signal is changed.
Figure 13:
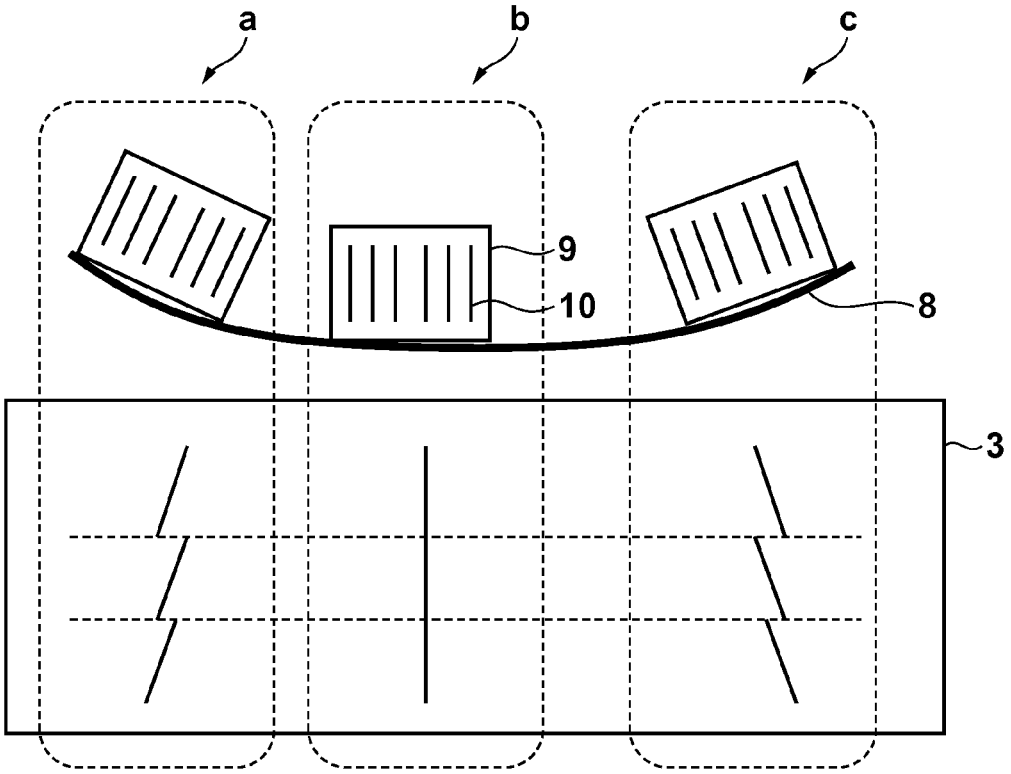
FIG. 13 is a view showing the relationship between the head slant and the formed image.

FIG. 12 is a view schematically showing the state where ink is discharged from the printhead to print, thereby forming dots when the generation timing of a block trigger signal is changed. In an example shown in FIG. 12, a block trigger signal is generated at a time interval corresponding to a resolution half the printing resolution (C and D in FIG. 10). Therefore, the generation timing of a block trigger signal generated for the period of a heat pulse signal shortens, so the formed dot width also shortens. In this example, dot formation is attained at a width 34 corresponding to a half column.

With the above-mentioned arrangement, to achieve fine line printing, it is effective to shorten the generation timing of a block trigger signal. However, the generation interval of a block trigger signal is also limited by the time period to transfer energy required to discharge ink, so a method of shifting the printing resolution in accordance with the condition of ink discharge of the printhead is selected.

In the above-mentioned embodiment, to divide image data to print by scanning twice in the same scanning region, the printing speed lowers in practice. However, as long as the condition in which ink is discharged from the printhead is satisfied, slant correction at each column can be done in the carriage moving direction without lowering the overall throughput by doubling the transfer speed or discharge frequency of a printing data signal.

Also, divided image data may be printed by other nozzles. When, for example, two nozzle arrays are used for printing using one ink, image data of first scanning may be distributed to the first nozzle array, and that of second scanning may be distributed to the second nozzle array. In this case, data of head slant in the carriage scanning region must be common to two nozzle arrays, but is almost equal to each other when the distance between the nozzle arrays is short.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-206312, filed Sep. 19, 2012, which is hereby incorporated by reference herein in its entirety.

What is claimed is:

1. A printing apparatus which prints by discharging ink from a plurality of nozzles onto a print medium while reciprocally scanning a carriage, which mounts a printhead on which the plurality of nozzles are arrayed, in a direction crossing a direction in which the plurality of nozzles are arrayed, the apparatus comprising:

an obtaining unit configured to obtain slant information indicating a slant between the direction in which the nozzles are arrayed, and a moving direction of the carriage, for each position corresponding to a printing column in the moving direction of the carriage by reading a predetermined pattern printed on a print medium by the printhead using an optical sensor;

a print buffer configured to store image data in association with the printing column;

a detection unit configured to detect a position of the carriage;

a reading unit configured to read image data corresponding to the printing column stored in the print buffer by separating the image data into image data used for printing by first scanning of the printhead and image data used for printing by second scanning of the printhead in a same region as that in which printing is done by the first scanning, based on the position of the carriage detected by said detection unit and the slant information in the position of the carriage corresponding to the printing column obtained by said obtaining unit; and a control unit configured to control the printhead so as to print by scanning the same region by the first scanning and the second scanning, using the image data read by said reading unit.

2. The apparatus according to claim 1, wherein the optical sensor is provided to the carriage, and said obtaining unit obtains the slant information while printing the pattern by the printhead.

3. The apparatus according to claim 1, wherein said reading unit divides the image data into image data used for printing by the first scanning and image data used for printing by the second scanning, for the each printing column for each of the plurality of nozzles.

4. The apparatus according to claim 3, wherein said reading unit shifts an address, at which image data used for printing from each of the plurality of nozzles is read from said print buffer, based on the slant information for the each printing column.

5. The apparatus according to claim 1, wherein said control unit controls a discharge timing of ink from the printhead to shift printing positions of printing in the first scanning and printing in the second scanning by a half of a printing resolution in a scanning direction of the carriage.

6. The apparatus according to claim 5, wherein said reading unit reads image data used for printing by first scanning of the printhead and image data used for printing by second scanning of the printhead in a same region as that in which the image data is printed by the first scanning not only so as not to be repeatedly used for printing in the first scanning and the second scanning, but also so as not to be used for printing in either of the first scanning and the second scanning.

7. The apparatus according to claim 1, wherein said control unit controls a discharge timing of ink from the printhead to print in the first scanning by a first half of a period corresponding to a printing resolution in a scanning direction of the carriage and to print in the second scanning by a second half of the period corresponding to the printing resolution in the scanning direction of the carriage.

8. The apparatus according to claim 1, wherein the printhead is mounted on the carriage so that the direction in which the nozzles are arrayed is perpendicular to the moving direction of the carriage.

9. A printing method in a printing apparatus which prints by discharging ink from a plurality of nozzles onto a print medium while reciprocally scanning a carriage, which mounts a printhead on which the plurality of nozzles are arrayed, in a direction crossing a direction in which the plurality of nozzles are arrayed, comprising the steps of:

obtaining slant information indicating a slant between the direction in which the nozzles are arrayed, and a moving direction of the carriage, for each position corresponding to a printing column in the moving direction of the carriage by reading a predetermined pattern printed on a print medium by the printhead using an optical sensor;

detecting a position of the carriage;

reading image data corresponding to the printing column stored in a print buffer in association with each printing column by separating the image data into image data used for printing by first scanning of the printhead and image data used for printing by second scanning of the printhead in a same region as that in which printing is done by the first scanning, based on the detected position of the carriage and the slant information in the position of the carriage corresponding to the printing column; and controlling the printhead so as to print by scanning the same region by the first scanning and the second scanning, using the read image data.

10. A printing apparatus which prints by discharging ink from a plurality of nozzles onto a print medium while reciprocally scanning a carriage, which mounts a printhead on which the plurality of nozzles are arrayed, in a direction crossing a direction in which the plurality of nozzles are arrayed, the apparatus comprising:

an obtaining unit configured to obtain slant information indicating a slant between the direction in which the nozzles are arrayed, and a moving direction of the carriage, for each position corresponding to a printing column in the moving direction of the carriage by reading a predetermined pattern printed on a print medium by the printhead using an optical sensor, wherein the slant in one printing column in the moving direction of the carriage is different from that in another printing column in the moving direction of the carriage;

a print buffer configured to store image data in association with the printing column;

a detection unit configured to detect a position of the carriage;

a reading unit configured to read image data corresponding to the printing column stored in the print buffer by separating the image data into image data used for printing by first scanning of the printhead and image data used for printing by second scanning of the printhead in a same region as that in which printing is done by the first scanning, based on the position of the carriage detected by said detection unit and the slant information in the position of the carriage corresponding to the printing column obtained by said obtaining unit; and a control unit configured to control the printhead so as to print by scanning the same region by the first scanning and the second scanning, using the image data read by said reading unit, wherein said reading unit reads image data used for printing by first scanning of the printhead and image data used for printing by second scanning of the printhead in a same region as that in which the image data is printed by the first scanning not only so as not to be repeatedly used for printing in the first scanning and the second scanning, but also so as not to be used for printing in either of the first scanning and the second scanning.

11. A printing method in a printing apparatus which prints by discharging ink from a plurality of nozzles onto a print medium while reciprocally scanning a carriage, which mounts a printhead on which the plurality of nozzles are arrayed, in a direction crossing a direction in which the plurality of nozzles are arrayed, comprising the steps of:

obtaining slant information indicating a slant between the direction in which the nozzles are arrayed, and a moving direction of the carriage, for each position corresponding to a printing column in the moving direction of the carriage by reading a predetermined pattern printed on a print medium by the printhead using an optical sensor, wherein the slant in one printing column in the moving direction of the carriage is different from that in another printing column in the moving direction of the carriage;

detecting a position of the carriage;

reading image data corresponding to the printing column stored in a print buffer in association with each printing column by separating the image data into image data used for printing by first scanning of the printhead and image data used for printing by second scanning of the printhead in a same region as that in which printing is done by the first scanning, based on the detected position of the carriage and the slant information in the position of the carriage; and controlling the printhead so as to print by scanning the same region by the first scanning and the second scanning, using the read image data, wherein at said reading, image data used for printing by first scanning of the printhead and image data used for printing by second scanning of the printhead in a same region as that in which the image data is printed by the first scanning are read not only so as not to be repeatedly used for printing in the first scanning and the second scanning, but also so as not to be used for printing in either of the first scanning and the second scanning.

* * * * *